US011067300B2

(12) United States Patent
Sakal et al.

(10) Patent No.: US 11,067,300 B2
(45) Date of Patent: Jul. 20, 2021

(54) PACKAGED TERMINAL AIR CONDITIONER UNIT HAVING A REMOVABLE EXHAUST AIR FILTER

(71) Applicant: Haier US Appliance Solutions, Inc., Wilmington, DE (US)

(72) Inventors: Eric Ormsby Sakal, Louisville, KY (US); Stephen Budelsky, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 112 days.

(21) Appl. No.: 16/507,347

(22) Filed: Jul. 10, 2019

(65) Prior Publication Data

US 2021/0010690 A1 Jan. 14, 2021

(51) Int. Cl.

| | |
|---|---|
| ***F24F 1/035*** | (2019.01) |
| ***F24F 1/027*** | (2019.01) |
| ***F24F 1/028*** | (2019.01) |

(52) U.S. Cl.

CPC ..... *F24F 1/035* (2019.02); *F24F 1/027* (2013.01); *F24F 1/028* (2019.02)

(58) Field of Classification Search

CPC ..... F24F 1/035; F24F 1/028; F24F 1/027

See application file for complete search history.

(56) References Cited

U.S. PATENT DOCUMENTS

| | | | | |
|---|---|---|---|---|
| 2,906,232 A * | 9/1959 | Waite | ..... | G01D 11/28 116/286 |
| 4,334,899 A | 6/1982 | McConnell | | |
| 9,352,259 B2 | 5/2016 | Lu | | |
| 9,535,407 B2 * | 1/2017 | Durham | ..... | F24F 11/62 |

FOREIGN PATENT DOCUMENTS

| | | | |
|---|---|---|---|
| KR | 2006098298 A | | 9/2006 |
| KR | 20060098298 A | * | 9/2006 |

OTHER PUBLICATIONS

Translation of KR20060098298A (Year: 2006).*

Amana, Amana PTAC Maintenance & Cleaning: A Reference Guide, Total Home Supply, May 12, 2015, 9 pages.

* cited by examiner

*Primary Examiner* — Marc E Norman
*Assistant Examiner* — Schyler S Sanks
(74) *Attorney, Agent, or Firm* — Dority & Manning, P.A.

(57) ABSTRACT

A packaged terminal air conditioner unit, as provided herein, may include a housing, an outdoor heat exchanger assembly, an indoor heat exchanger assembly, a compressor, and a filter assembly. The housing may define an indoor portion and an outdoor portion. The filter assembly may be supported on the housing. The filter assembly may include a support bracket attached to the housing, an exhaust air filter, and a louver cap. The exhaust air filter may be disposed on the support bracket in fluid communication with the indoor portion to receive air therefrom. The louver cap may be disposed over the exhaust air filter and downstream therefrom. The louver cap may be selectively attached to the support bracket.

20 Claims, 11 Drawing Sheets

PACKAGED TERMINAL AIR CONDITIONER UNIT HAVING A REMOVABLE EXHAUST AIR FILTER

FIELD OF THE INVENTION

The present subject matter relates generally to air conditioner units and more particularly to packaged terminal air conditioners having removable air filter for air that has already been heated or cooled by the air conditioner.

BACKGROUND OF THE INVENTION

Air conditioner or conditioning units are conventionally utilized to adjust the temperature indoors (i.e., within structures such as dwellings and office buildings). For example, a packaged terminal air conditioners (PTAC) may be used to adjust the temperature in, for example, a single room or group of rooms of a structure. A PTAC unit includes an indoor portion and an outdoor portion. The indoor portion generally communicates (e.g., exchanges air) with the room/group of rooms within a building, and the outdoor portion generally communicates (e.g., exchanges air) with the area outside the building. Accordingly, the air conditioner unit generally extends through, for example, a wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit.

One issue that may arise during the use of a conventional air conditioner (e.g., PTAC) is the presence of dust, debris, or allergens. In particular, the presence of such dust, debris, or allergens may be accumulated within or recirculated through the indoor portion of the air conditioner. This may create an undesirable condition within the room. Additionally or alternatively, this may be detrimental to performance (e.g., efficacy or efficiency) of the air conditioner unit. Some existing systems have incorporated air filters (e.g., relatively high-efficiency air filters) to address such issues. However, such air filters are often mounted within the air conditioner in such a way that accessing or replacing the air filter is very difficult. Often, a user must use multiple tools or disassembly an entire front housing (e.g., covering the indoor portion) to even view the air filter. This inconvenience may lead to irregular replacement or cleaning of the air filter. This can be especially detrimental to performance if a filter with a large Minimum Efficiency Reporting Value (MERV) rating (e.g., MERV 13), which are increasingly being required by various governments' laws and regulations. Additionally or alternatively, removing a large portion of a housing may provide access to features (such as controller) that should not be accessed or altered by a typical user (e.g., due to the risk of damage or injury).

As a result, an air conditioner addressing one or more of the above issues would be useful. In particular, it may be advantageous to provide an air conditioner having one or more features that could be easily removed (e.g., without the use of tools), such as without removing an entire front housing.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a packaged terminal air conditioner unit is provided. The packaged terminal air conditioner unit may include a housing, an outdoor heat exchanger assembly, an indoor heat exchanger assembly, a compressor, and a filter assembly. The housing may define an indoor portion and an outdoor portion. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The compressor may circulate a refrigerant between the outdoor heat exchanger and the indoor heat exchanger. The filter assembly may be supported on the housing. The filter assembly may include a support bracket attached to the housing, an exhaust air filter, and a louver cap. The exhaust air filter may be disposed on the support bracket in fluid communication with the indoor portion to receive air therefrom. The louver cap may be disposed over the exhaust air filter and downstream therefrom. The louver cap may be selectively attached to the support bracket.

In another exemplary aspect of the present disclosure, a packaged terminal air conditioner unit is provided. The packaged terminal air conditioner unit may include a housing, an outdoor heat exchanger assembly, an indoor heat exchanger assembly, a compressor, a bulkhead, and a filter assembly. The housing may define an indoor portion and an outdoor portion. The housing may include a cabinet enclosing at least a portion of the indoor portion and a head unit attached to the cabinet above the indoor portion. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The compressor may circulate a refrigerant between the outdoor heat exchanger and the indoor heat exchanger. The bulkhead may be disposed within the housing between the outdoor heat exchanger and the indoor heat exchanger along a transverse direction. The bulkhead may define a vent aperture therethrough.

The filter assembly may be supported on the housing. The filter assembly may include a support bracket attached to the head unit above the indoor heat exchanger, an exhaust air filter, and a louver cap. The exhaust air filter may be disposed on the support bracket in fluid communication with the indoor portion to receive air therefrom. The louver cap may be disposed over the exhaust air filter and downstream therefrom. The louver cap may be selectively attached to the support bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
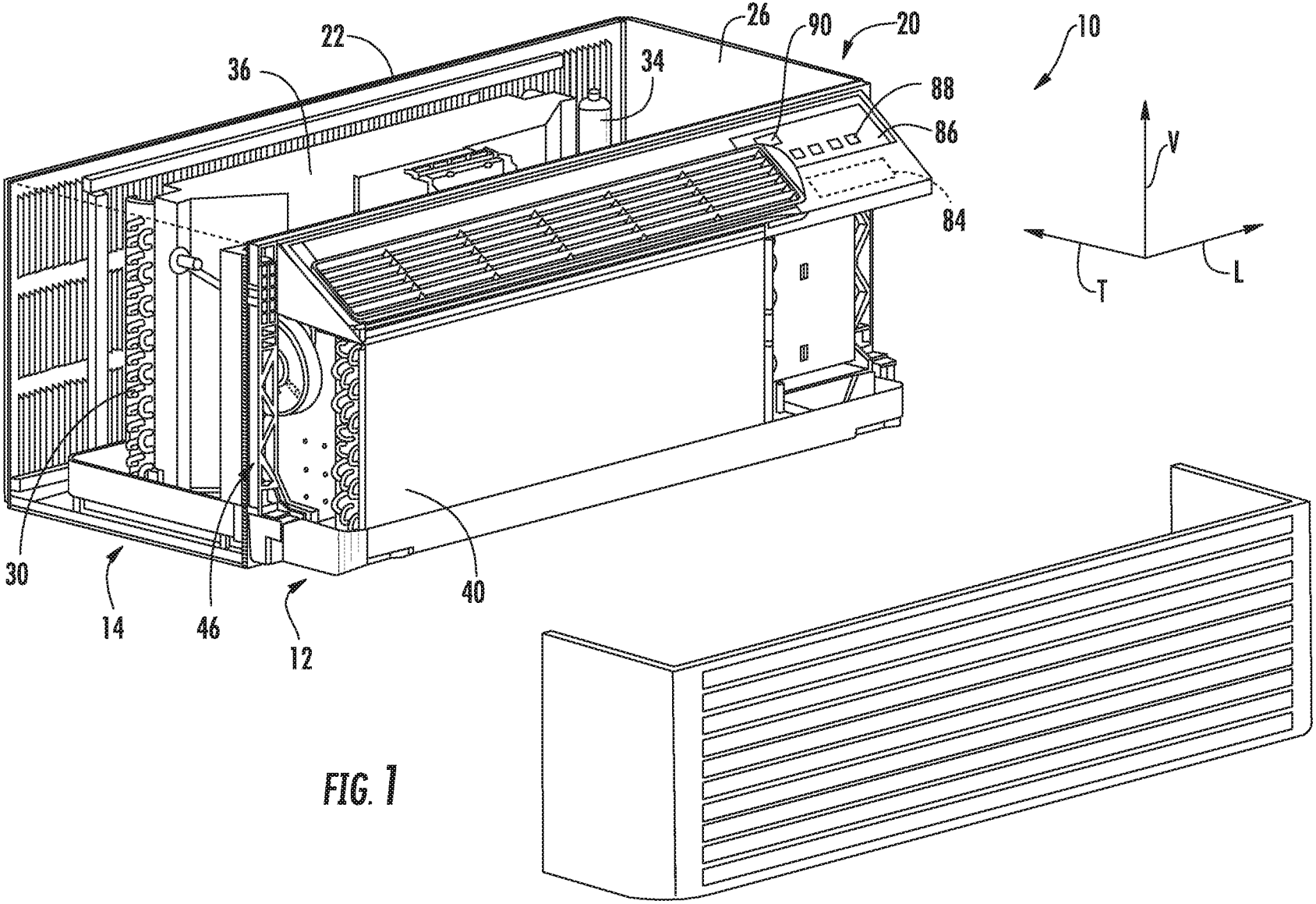
FIG. 1 provides a perspective view of an air conditioner unit, with part of an indoor portion exploded from a remainder of the air conditioner unit for illustrative purposes, in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow (e.g., airflow or refrigerant flow) in a fluid pathway. For example, "upstream" refers to the flow direction from which the fluid flows, and "downstream" refers to the flow direction to which the fluid flows.

Referring now to FIG. 1, an air conditioner unit 10 is provided. The air conditioner unit 10 is a one-unit type air conditioner, also conventionally referred to as a packaged terminal air conditioner (PTAC) unit. The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, outdoor fan 32, and compressor 34 may be housed within the wall sleeve 26. A casing 36 may additionally enclose the outdoor fan 32, as shown.

Figure 2:
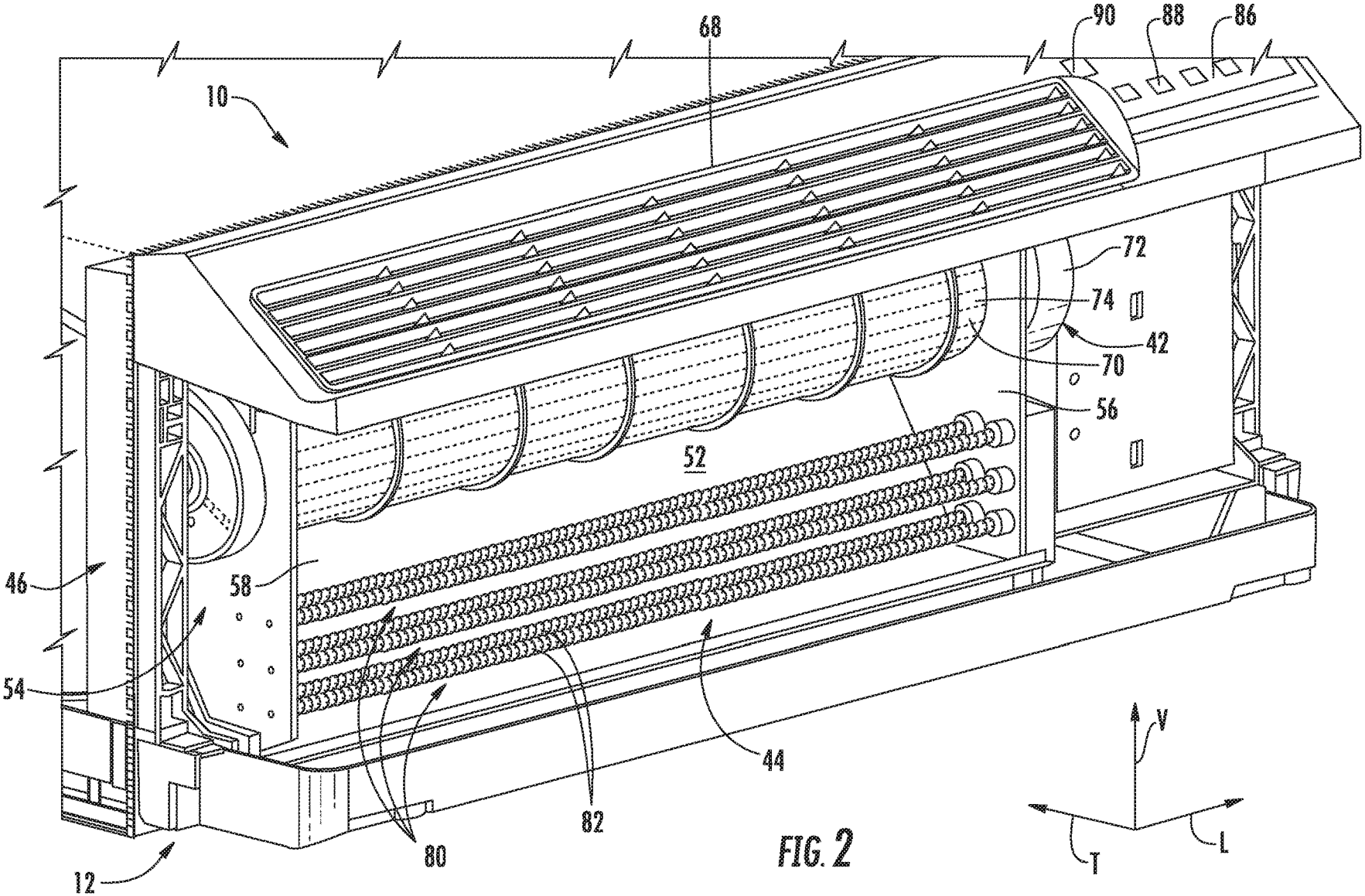
FIG. 2 is a perspective view of components of an indoor portion of an air conditioner unit in accordance with one exemplary embodiment of the present disclosure.

Referring now also to FIG. 2, indoor portion 12 may include, for example, an indoor heat exchanger 40, a blower fan 42, and a heating unit 44. These components may, for example, be housed behind the room front 24. Additionally, a bulkhead 46 may generally support or house various other components or portions thereof of the indoor portion 12, such as the blower fan 42 and the heating unit 44. Bulkhead 46 may generally separate and define the indoor portion 12 and outdoor portion 14.

Figure 3:
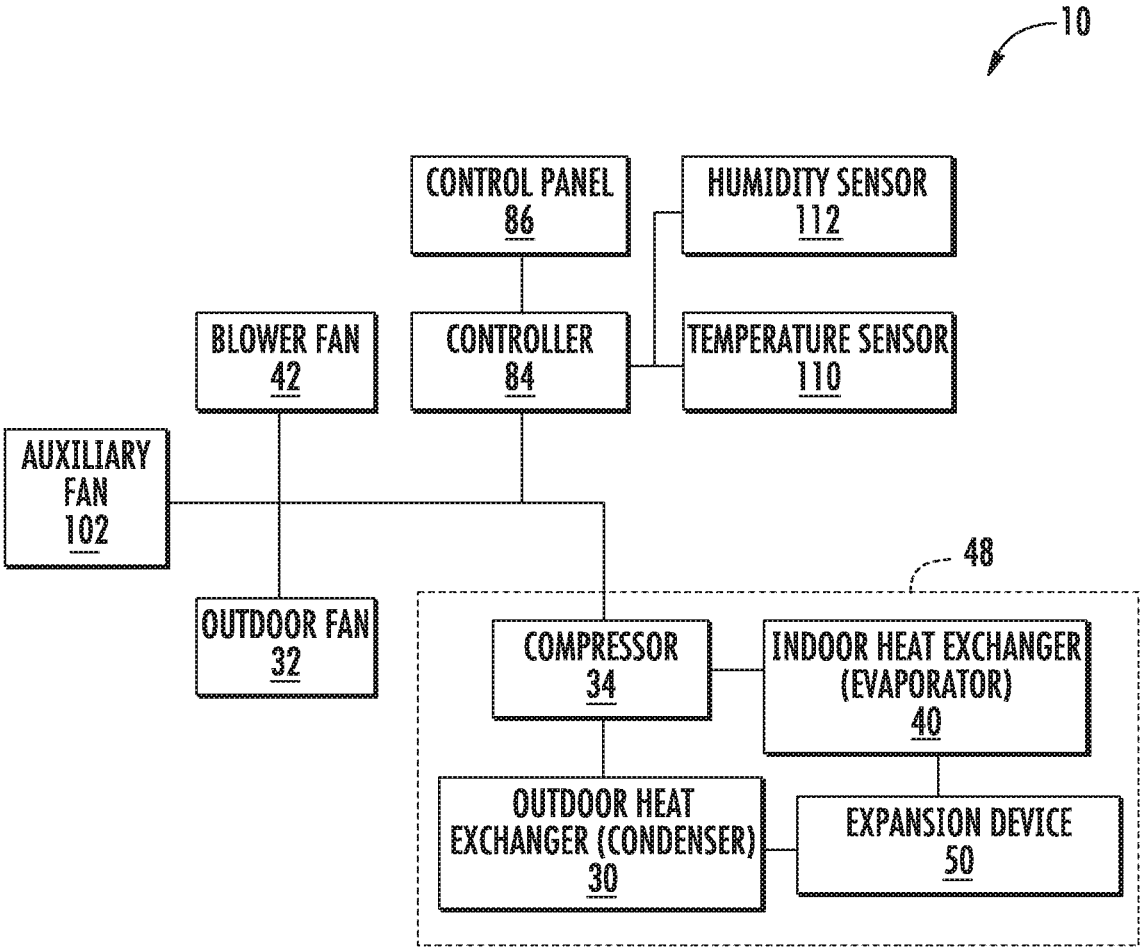
FIG. 3 is a schematic view of a refrigeration loop in accordance with exemplary embodiments of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. One suitable refrigerant for use in refrigeration loop 48 is 1,1,1,2-Tetrafluoroethane, also known as R-134A, although it should be understood that the present disclosure is not limited to such example and rather that any suitable refrigerant may be utilized.

As is understood in the art, refrigeration loop 48 may be alternately operated as a refrigeration assembly (and thus perform a refrigeration cycle) or a heat pump (and thus perform a heat pump cycle). When refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

In exemplary embodiments as illustrated, expansion device 50 may be disposed in the outdoor portion 14 between the indoor heat exchanger 40 and the outdoor heat exchanger 30. Optionally, expansion device 50 may be an electronic expansion valve that enables controlled expansion of refrigerant, as is generally understood. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. In alternative embodiments, expansion device 50 may be a capillary tube or another suitable expansion device configured for use in a thermodynamic cycle.

Turning generally to FIGS. 1, 2, and 4 through 8, bulkhead 46 may include various peripheral surfaces that define an interior 52 thereof. For example, bulkhead 46 may include a first sidewall 54 and a second sidewall 56 which are spaced apart from each other along the lateral direction L. A rear wall 58 may extend laterally between the first sidewall 54 and second sidewall 56. The rear wall 58 may, for example, include an upper portion 60 and a lower portion 64. Lower portion 64 may have a generally linear cross-sectional shape, and may be positioned below upper portion 60 along the vertical direction V. Rear wall 58 may further include an indoor facing surface and an opposing outdoor facing surface. The indoor facing surface may face the interior 52 and indoor portion 12, and the outdoor facing surface may face the outdoor portion 14. Bulkhead 46 may additionally extend between a top end 62 and a bottom end 66 along vertical axis V. Upper portion 60 may, for example, include top end 62, while lower portion 64 may, for example, include bottom end 66.

As shown, a head unit 68 may be attached to the cabinet 20 (e.g., on or adjacent to bulkhead 46, such as on the upper portion 60). Specifically, the head unit 68 may be positioned at or above the indoor portion 12 as part of the housing 20. In some such embodiments, the head unit 68 is further positioned above the blower fan 42. In additional or alternative embodiments, the head unit 68 extends at least from the first sidewall 54 to the second sidewall 56. Generally, the head unit 68 may define one or more openings through which air may flow (e.g., from the indoor portion 12 to the corresponding room). As will be described in greater detail below, a filter assembly 120 may be included with the head unit 68 (e.g., supported thereon) to filter an airflow from the air conditioner unit 10 after the air therein has already been treated (e.g., cooled or heated) through the air conditioner unit 10.

In some embodiments, upper portion 60 of the bulkhead 46 has a generally curvilinear cross-sectional shape, and may accommodate a portion of the blower fan 42, which may be, for example, a centrifugal fan. Alternatively, however, any suitable fan type may be utilized. Blower fan 42 may include a blade assembly 70 and a motor 72. The blade assembly 70, which may include one or more blades disposed within a fan housing 74, may be disposed at least partially within the interior 52 of the bulkhead 46, such as within the upper portion 60. As shown, blade assembly 70 may for example extend along the lateral direction L between the first sidewall 54 and the second sidewall 56. The motor 72 may be connected to the blade assembly 70, such as through the housing 74 to the blades via a shaft. Operation of the motor 72 may rotate the blades, thus generally operating the blower fan 42. Further, in exemplary embodiments, motor 72 may be disposed exterior to the bulkhead 46. Accordingly, the shaft may for example extend through one of the sidewalls 54, 56 to connect the motor 72 and blade assembly 70.

According to the illustrated embodiment, blower fan 42 may operate as an evaporator fan in refrigeration loop 48 to encourage the flow of air through indoor heat exchanger 40. Accordingly, blower fan 42 may be positioned downstream of indoor heat exchanger 40 along the flow direction of indoor air and downstream of heating unit 44 along the flow direction of outdoor air (when make-up air is being supplied). Alternatively, blower fan 42 may be positioned upstream of indoor heat exchanger 40 along the flow direction of indoor air, and may operate to push air through indoor heat exchanger 40.

Heating unit 44 in exemplary embodiments includes one or more heater banks 80. Each heater bank 80 may be operated as desired to produce heat. In some embodiments as shown, three heater banks 80 may be utilized. Alternatively, however, any suitable number of heater banks 80 may be utilized. Each heater bank 80 may further include at least one heater coil or coil pass 82, such as in exemplary embodiments two heater coils or coil passes 82. Alternatively, other suitable heating elements may be utilized.

The operation of air conditioner unit 10 including compressor 34 (and thus refrigeration loop 48 generally) blower fan 42, outdoor fan 32, heating unit 44, expansion device 50, and other components of refrigeration loop 48 may be controlled by a processing device such as a controller 84. Controller 84 may be in communication (via for example a suitable wired or wireless connection) to such components of the air conditioner unit 10. By way of example, the controller 84 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 86 and one or more user inputs 88, which may be included in control panel 86. The user inputs 88 may be in communication with the controller 84. A user of the unit 10 may interact with the user inputs 88 to operate the unit 10, and user commands may be transmitted between the user inputs 88 and controller 84 to facilitate operation of the unit 10 based on such user commands. A display 90 may additionally be provided in the control panel 86, and may be in communication with the controller 84. Display 90 may, for example be a touchscreen or other text-readable display screen, or alternatively may simply be a light that can be activated and deactivated as required to provide an indication of, for example, an event or setting for the unit 10.

Figure 4:
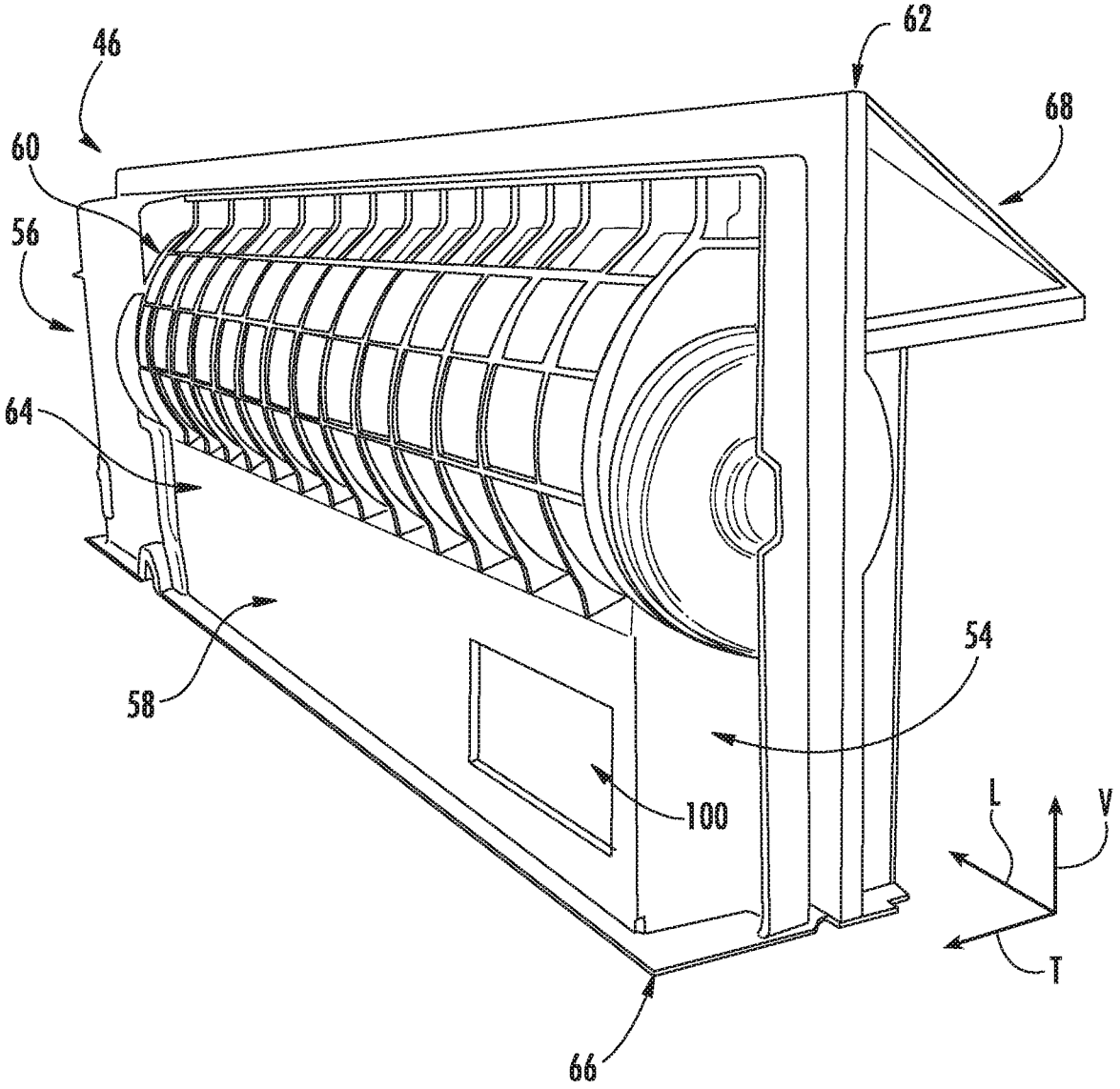
FIG. 4 is a rear perspective view of a bulkhead assembly in accordance with exemplary embodiments of the present disclosure.
Figure 5:
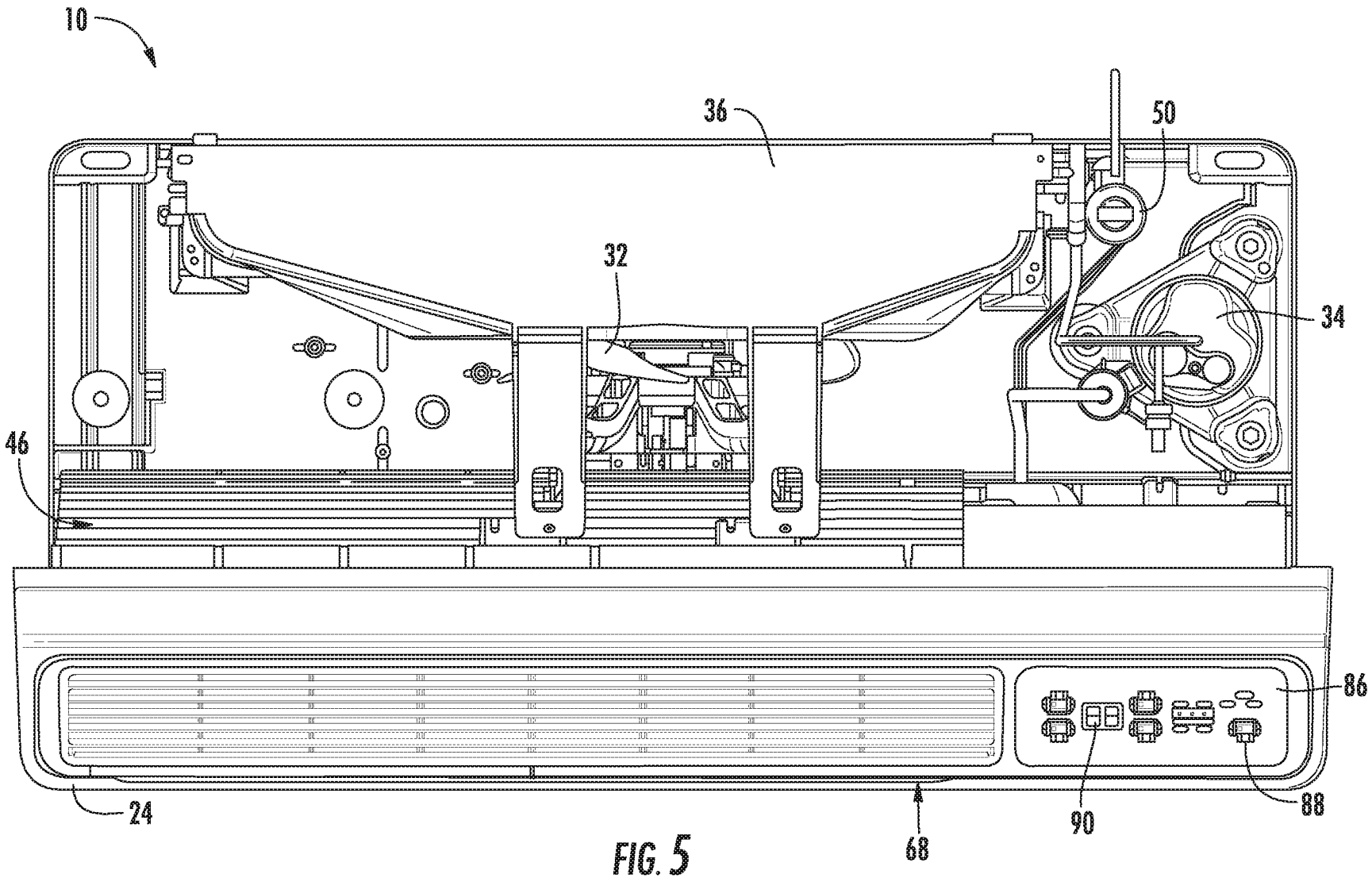
FIG. 5 is a top view of components of an air conditioner unit in accordance with exemplary embodiments of the present disclosure.
Figure 6:
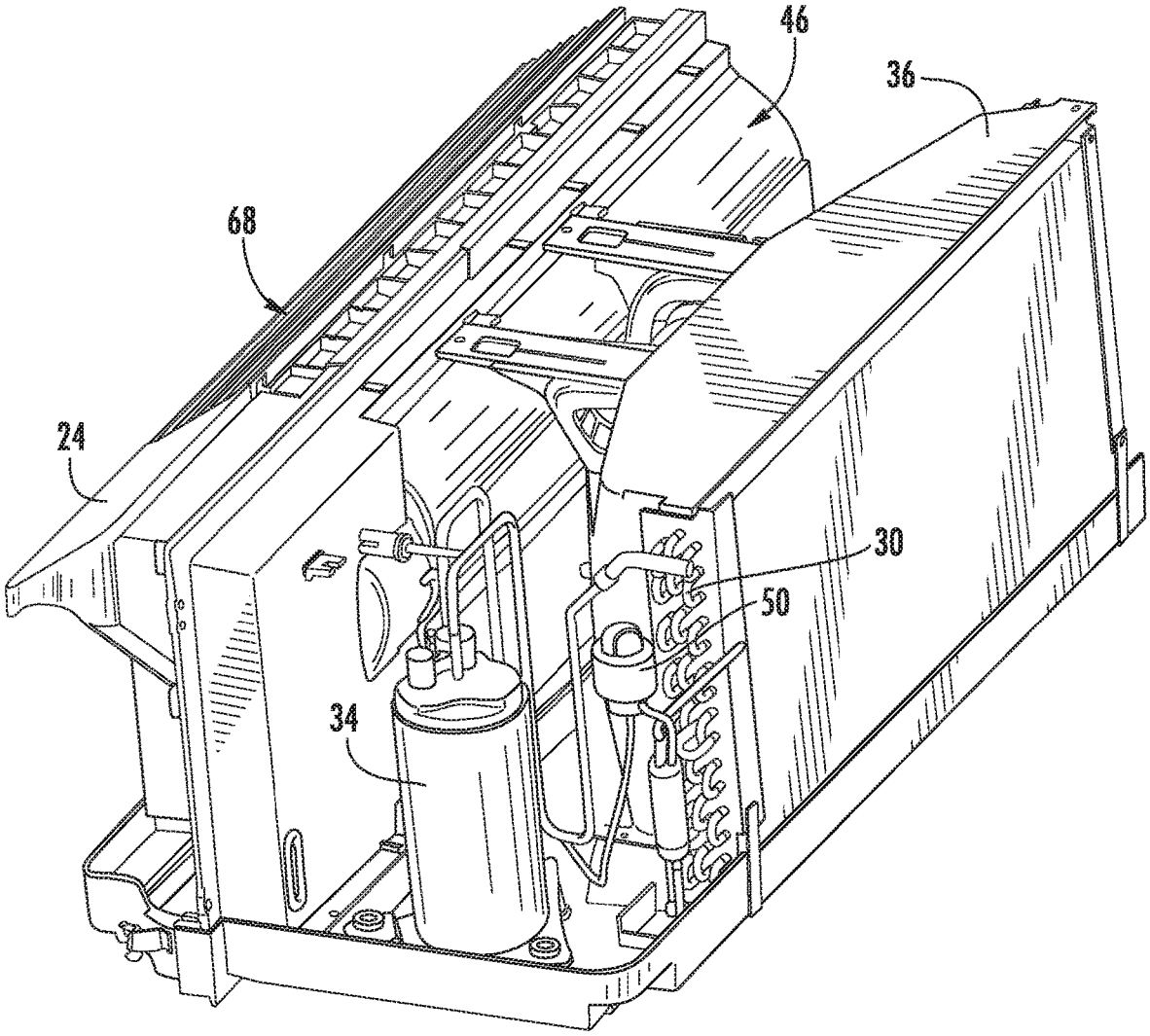
FIG. 6 is a rear perspective view of components of an outdoor portion of an air conditioner unit in accordance with exemplary embodiments of the present disclosure.
Figure 7:
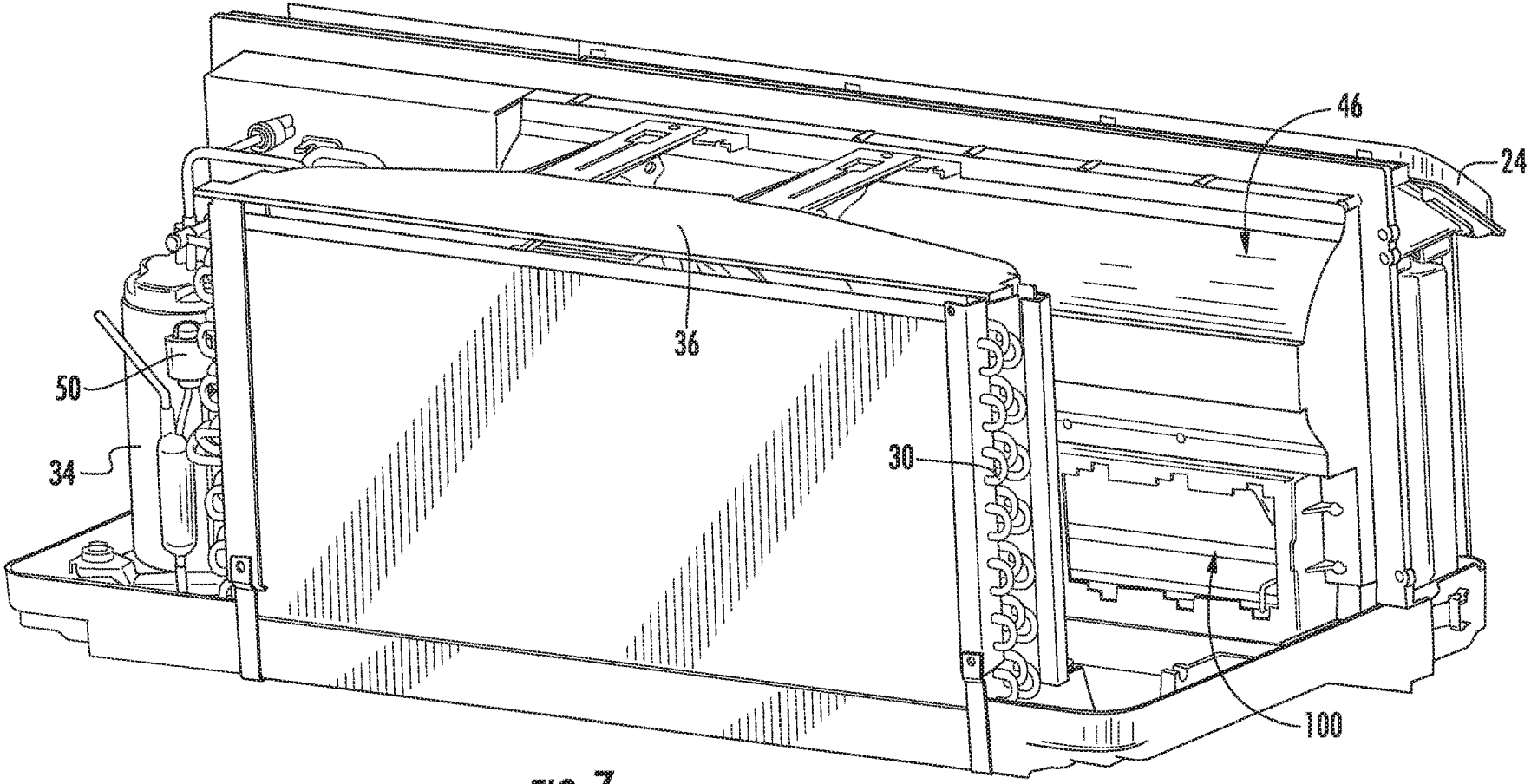
FIG. 7 is a rear perspective view of components of an outdoor portion of an air conditioner unit in accordance with exemplary embodiments of the present disclosure.
Figure 8:
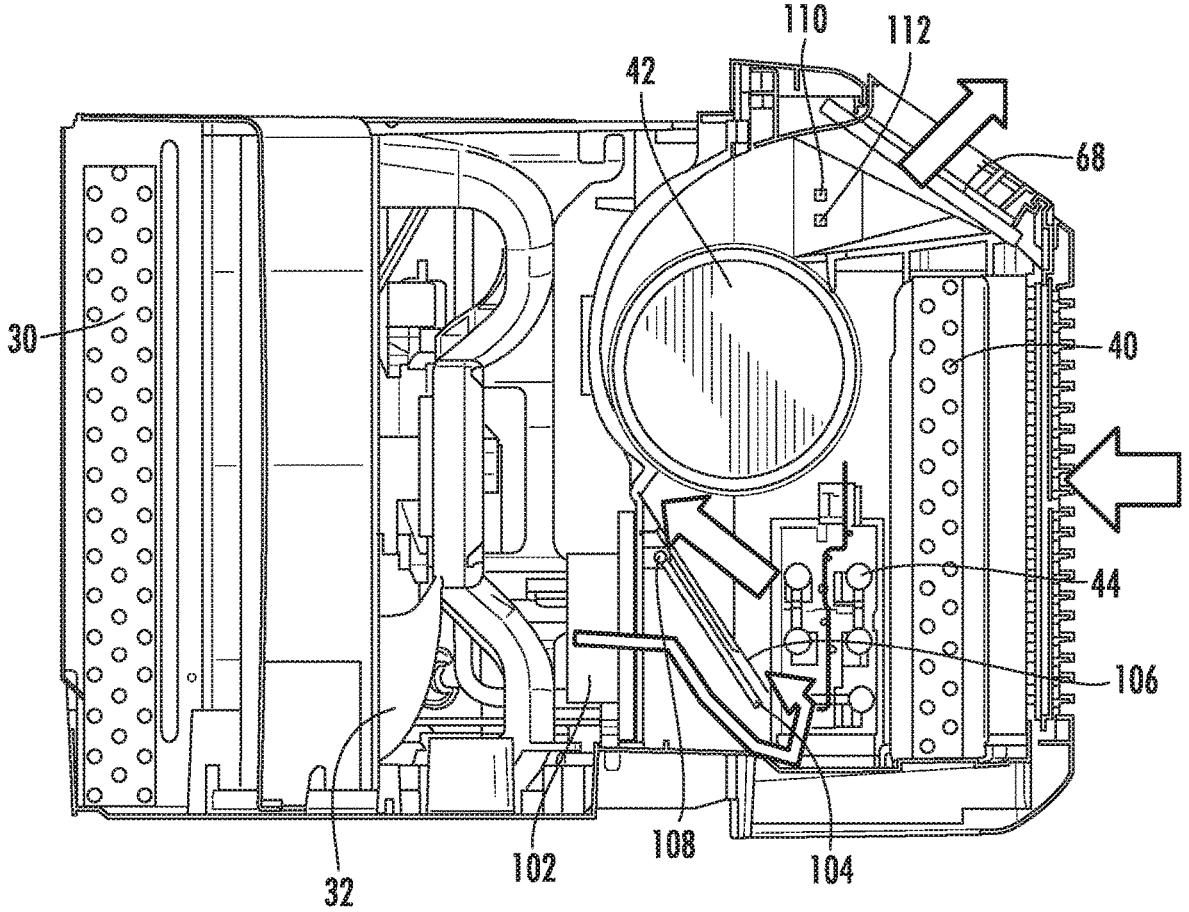
FIG. 8 is a side sectional view of components of an air conditioner unit in accordance with exemplary embodiments of the present disclosure.
Figure 9:
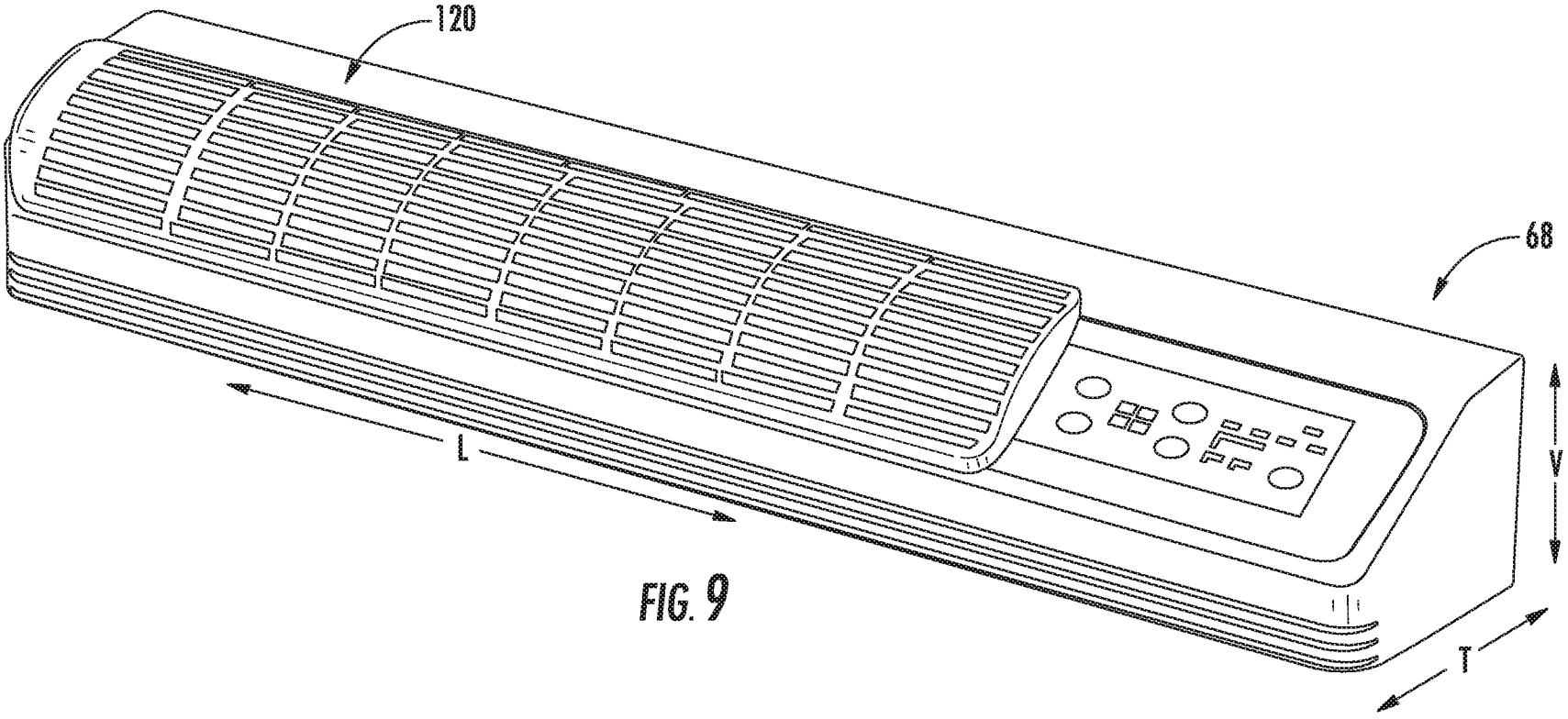
FIG. 9 provides a perspective view of components of a head unit of an air conditioner unit in accordance exemplary embodiments of the present disclosure.
Figure 10:
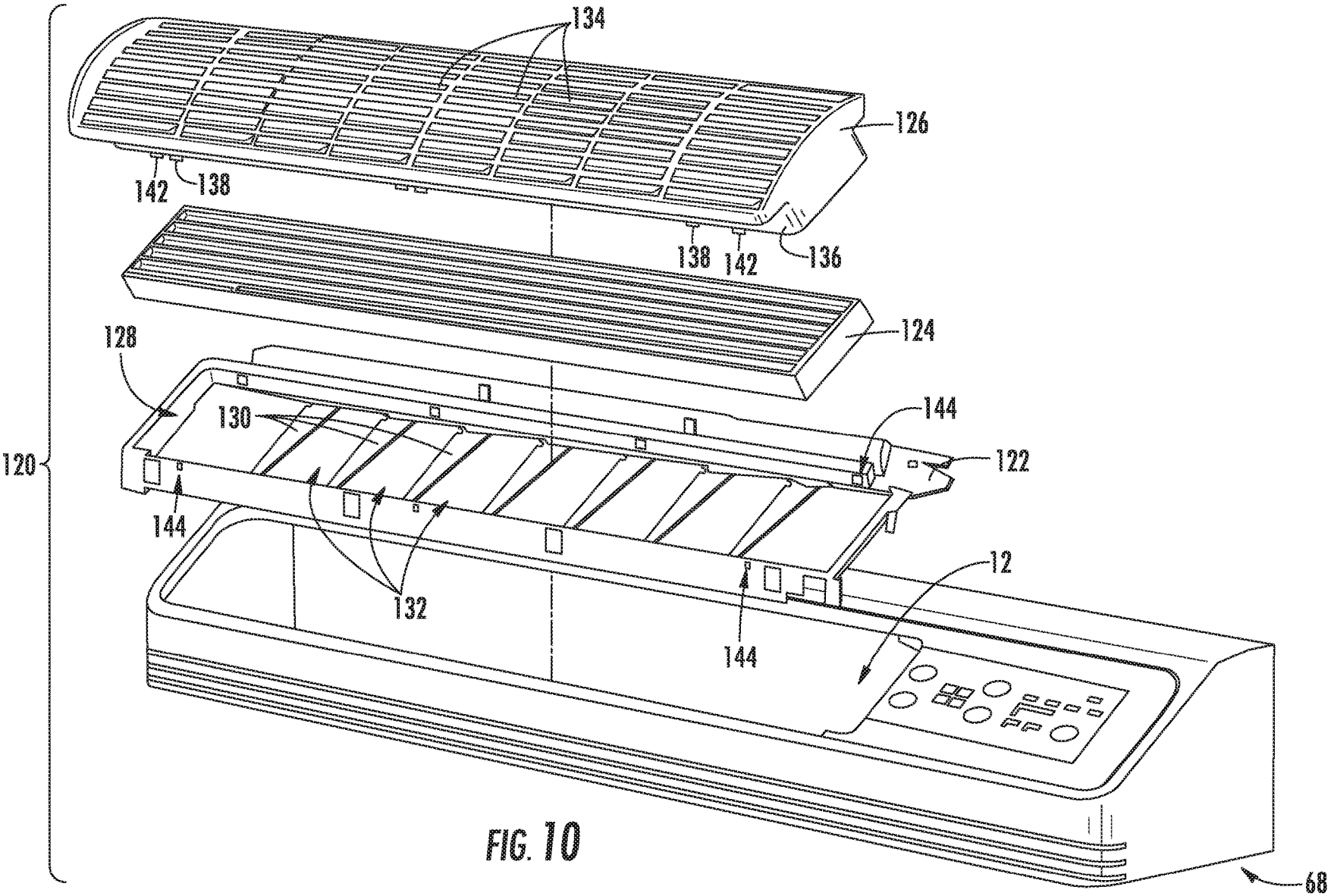
FIG. 10 provides an exploded perspective view of components of a head unit of an air conditioner unit in accordance exemplary embodiments of the present disclosure.
Figure 11:
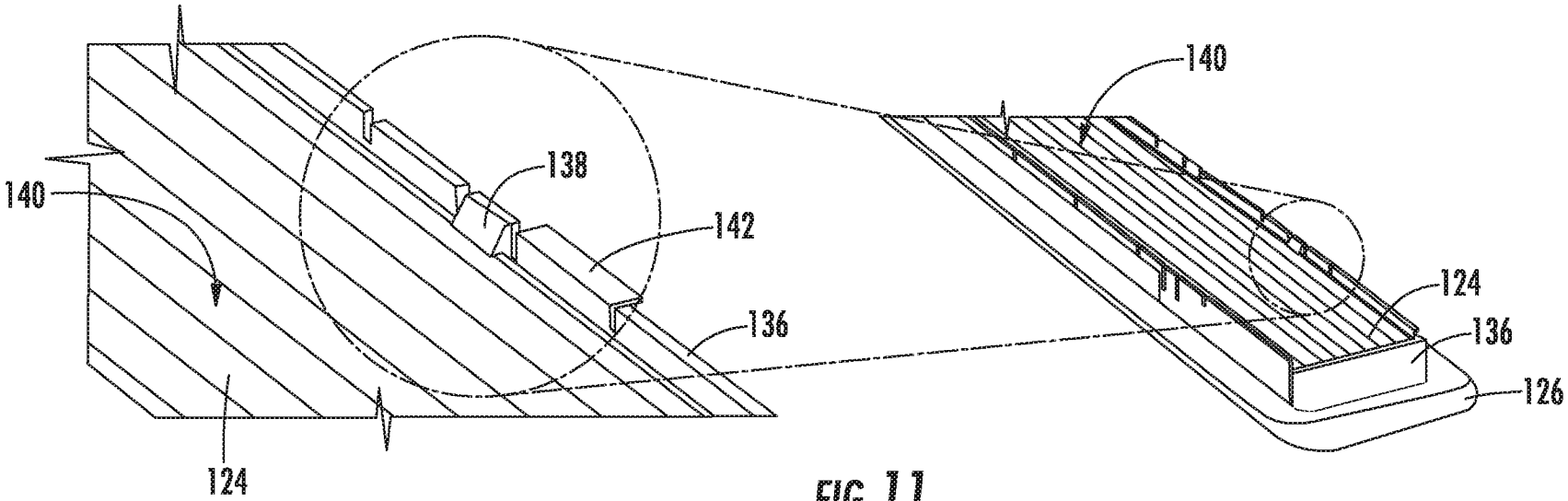
FIG. 11 provides a bottom perspective view of a portion of a louver cap and air filter in accordance exemplary embodiments of the present disclosure.

Referring especially to FIGS. 4 and 8, a vent aperture 100 may be defined in the rear wall 58 of bulkhead 46. Vent aperture 100 may allow air flow therethrough between the indoor portion 12 and outdoor portion 14, and may be utilized in an installed air conditioner unit 10 to allow outdoor air to flow therethrough into the room through the indoor portion 12. In this regard, in some cases it may be desirable to allow outside air to flow into the room in order to compensate for negative pressure created within the room by (e.g., turning on a bathroom fan). In this manner, according to an exemplary embodiment, outside air, also referred to as make-up air, may be provided into the room through vent aperture 100 when a negative pressure is created as air is drawn out of the room by the bathroom fan.

During use, blower fan 42 and outdoor fan 32 may be used to provide make-up air into the room when desired. However, in optional embodiments, air conditioner unit 10 further includes an auxiliary fan 102 that may be used with the existing refrigeration loop 48 force additional outdoor air through vent aperture 100. Auxiliary fan 102 may, according to the illustrated example embodiment, be positioned within outdoor portion 14 proximate to vent aperture 100. Additionally or alternatively, auxiliary fan 102 may be partially or wholly disposed in vent aperture 100 or partially or wholly disposed in indoor portion 12. Accordingly, auxiliary fan 102 may induce a flow of outdoor air from the outdoors through vent aperture 100 to the indoor portion 12.

In additional or alternative embodiments, air conditioner unit 10 may further include a temperature sensor 110 and a humidity sensor 112. Temperature sensor 110 and humidity sensor 112 may, for example, be disposed within indoor portion 12, and may be configured to measure the temperature and relative humidity, respectively, of air flowing into the room. As illustrated, sensors 110, 112 are positioned downstream of blower fan 42 and configured to measure the temperature and humidity of air right before it enters the room. However, one skilled in the art will appreciate that sensors 110, 112 may be positioned at any other suitable location within indoor portion 12, and that additional sensors may be used throughout unit 10. For example, sensors 110, 112 (or additional sensors) may be placed proximate to vent aperture 100 to sense the temperature and relative humidity of the make-up air flowing through vent aperture 100. Any suitable temperature sensor and humidity sensor may be utilized in accordance with the present disclosure.

Turning now especially to FIGS. 8 through 11, FIGS. 9 through 11 provide various views of portions of the air conditioner unit 10 (FIG. 1) that include the head unit 68 or filter assembly 120. As noted above, the filter assembly 120 may be provided to filter an airflow from the air conditioner unit 10 after the air therein has already been treated (e.g., cooled or heated) through the air conditioner unit 10. For instance, the filter assembly 120 may be supported on the head unit 68 or another suitable portion of the housing 20.

As shown, the filter assembly 120 generally includes a support bracket 122, an exhaust air filter 124, and a louver cap 126 that can be selectively attached to each other (e.g., directly or indirectly). In some embodiments, the support bracket 122 is provided on the head unit 68. For instance, the support bracket 122 may be mounted to the head unit 68 (e.g., via one or more adhesives, welds, solder, or mechanical fasteners). When assembled, the support bracket 122 may define an area or plane in which the exhaust air filter 124 can rest. The area or plane defined by the support bracket 122, as well as the support bracket 122 itself, may be positioned above the indoor heat exchanger 40.

In certain embodiments, support bracket 122 includes a periphery frame that defines an opening 128 through which air may from the indoor portion 12 (e.g., to the exhaust air filter 124). In other words, the opening 128 of the support bracket 122 may be provided upstream from the exhaust air filter 124 and downstream of the indoor portion 12 (e.g., indoor heat exchanger 40). In additional or alternative embodiments, multiple air channels 132 are defined at the opening 128. For instance, one or more struts 130 may extend across the opening 128 (e.g., beneath the exhaust air filter 124). If multiple struts 130 are provided, two or more of the struts 130 may be spaced apart from each other, such as along the lateral direction L such that a discrete air channel 132 is defined between adjacent struts 130.

As shown, the exhaust air filter 124 may be selectively disposed on the support bracket 122. Specifically, the exhaust air filter 124 may be positioned or disposed across the opening 128 defined by the support bracket 122. Generally, the exhaust air filter 124 may be provided as or include any suitable filtration media, such as a woven fiberglass, pleated panels, carbon, etc. In exemplary embodiments, a relatively high filtration media (i.e., filtration media having a large MERV rating or value) may be provided with the exhaust air filter 124. As an example, a MERV 13-rated filtration media may be included with the exhaust air filter 124 to filter or remove particles smaller than 1 μm from air passing through the indoor portion 12 or to the corresponding room within which the unit 10 is mounted. Advantageously, such embodiments may provide improved or superior filtration of air through the unit 10 (e.g., air downstream of an air intake, which is being returned to a surrounding room) than would be possible with conventional air conditioners having relatively ineffective, porous filtration systems.

When assembled, the louver cap 126 is disposed over the exhaust air filter 124. At least a portion of the louver cap 126 may be downstream from the exhaust air filter 124. For instance a plurality of louvers 134 may be positioned across the exhaust air filter 124 to define multiple apertures through which air must flow after existing the exhaust air filter 124. In some embodiments, louver cap 126 further includes a sidewall 136 that is disposed about (e.g., bounding or enclosing the perimeter of) the exhaust air filter 124. In optional embodiments, the exhaust air filter 124 is vertically-sandwiched between the louver cap 126 and the support bracket 122 (e.g., when assembled).

In certain embodiments, the exhaust air filter 124 is selectively fixed to the louver cap 126. Specifically, the exhaust air filter 124 may be secured to the louver cap 126 such that the louver cap 126 and exhaust air filter 124 can move in tandem (e.g., relative to the support bracket 122 or head unit 68). As an example, one or more interior tabs 138 may be provided on louver cap 126. Generally, the interior tabs 138 extend radially inward toward the exhaust air filter 124 or opening 128. In some such embodiments, the interior tabs 138 extend from a base portion of the louver cap 126 (e.g., a bottom end of the sidewall 136 that is opposite from the louvers 134). As the exhaust air filter 124 is received within the sidewall 136, the interior tabs 138 may extend beneath, for instance, a bottom surface 140 of the exhaust air filter 124. Contact or engagement between the interior tabs 138 and the exhaust air filter 124 may support the exhaust air filter 124 or hold the exhaust air filter 124 against another portion of the louver cap 126 (e.g., the louvers 134). Removal of the exhaust air filter 124 may require bending or deflecting the interior tabs 138 outward (e.g., radially outward away from the exhaust air filter 124) such that the exhaust air filter 124 may pass axially through the louver cap 126 (e.g., sidewall 136) and separate from the louver cap 126.

In some embodiments, the assembled filter assembly 120 includes the louver cap 126 in selective attachment with the support bracket 122. Thus, the louver cap 126 may be selectively removed from and reattached to the support bracket 122. In exemplary embodiments, the louver cap 126 is shaped to fit within or be received by the support bracket 122 (e.g., at the opening 128). In additional or alternative embodiments, a plurality of attachment tabs 142 are provided on the louver cap 126 (e.g., at the sidewall 136). For instance, the attachment tabs 142 may extend outward (e.g., radially outward) and toward the support bracket 122. A plurality of corresponding or complementary catches 144 may be defined on the support bracket 122 to engage or contact the attachment tabs 142. Thus, when louver cap 126 is received within the opening 128, the attachment tabs 142 may contact or engage the complementary catches 144, thereby restricting axial movement of the louver cap 126 relative to the support bracket 122. Removal of the louver cap 126 from the support bracket 122 may require bending or deflecting the attachment tabs 142 inward (e.g., radially inward away from the support bracket 122) such that the louver cap 126 may pass axially through the opening 128 and separate from the support bracket 122.

Advantageously, the exhaust air filter 124 may be accessed upon separating the louver cap 126 from the support bracket 122 and without requiring any further disassembly of the head unit 68 or cabinet 20.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit for conditioning an indoor space, the packaged terminal air conditioner unit comprising:

a housing defining an indoor portion and an outdoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor to circulate a refrigerant between the outdoor heat exchanger and the indoor heat exchanger; and a filter assembly supported on the housing, the filter assembly comprising a support bracket attached to the housing, an exhaust air filter disposed on the support bracket in fluid communication with the indoor portion to receive air therefrom, and a louver cap disposed over the exhaust air filter and downstream therefrom, the louver cap being selectively attached to the support bracket, wherein the exhaust air filter is selectively fixed to the louver cap to move therewith relative to the housing.

2. The packaged terminal air condition unit of claim 1, wherein the filter assembly is in downstream fluid communication with the indoor heat exchanger to receive indoor air therefrom.

3. The packaged terminal air condition unit of claim 1, wherein the filter assembly is in selective downstream fluid communication with the outdoor heat exchanger to receive makeup air therefrom.

4. The packaged terminal air condition unit of claim 3, further comprising:

a bulkhead disposed within the housing between the outdoor heat exchanger and the indoor heat exchanger along a transverse direction; and a vent aperture defined in the bulkhead upstream from the exhaust air filter.

5. The packaged terminal air condition unit of claim 1, wherein the support bracket defines a plurality of parallel air channels upstream from the exhaust air filter.

6. The packaged terminal air condition unit of claim 1, wherein the exhaust air filter is vertically-sandwiched between the louver cap and the support bracket.

7. The packaged terminal air condition unit of claim 1, wherein the louver cap comprises a plurality of louvers extending across a top surface of the exhaust air filter and plurality of interior tabs extending beneath a bottom surface of the exhaust air filter, the plurality of interior tabs holding the exhaust air filter against the plurality of louvers.

8. The packaged terminal air condition unit of claim 1, wherein the louver cap comprises a plurality of attachment tabs extending outward from the louver cap in selective engagement with the support bracket.

9. The packaged terminal air condition unit of claim 1, wherein the louver cap comprises a sidewall disposed about the exhaust air filter.

10. A packaged terminal air conditioner unit for conditioning an indoor space, the packaged terminal air conditioner unit comprising:

a housing defining an indoor portion and an outdoor portion, the housing comprising a cabinet enclosing at least a portion of the indoor portion and a head unit attached to the cabinet above the indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor to circulate a refrigerant between the outdoor heat exchanger and the indoor heat exchanger;

a bulkhead disposed within the housing between the outdoor heat exchanger and the indoor heat exchanger along a transverse direction, the bulkhead defining a vent aperture therethrough; and a filter assembly supported on the head unit, the filter assembly comprising a support bracket attached to the head unit above the indoor heat exchanger, an exhaust air filter disposed on the support bracket in fluid communication with the indoor portion to receive air therefrom, and a louver cap disposed over the exhaust air filter and downstream therefrom, the louver cap being selectively attached to the support bracket, wherein the exhaust air filter is selectively fixed to the louver cap to move therewith relative to the housing.

11. The packaged terminal air condition unit of claim 10, wherein the filter assembly is in selective downstream fluid communication with the outdoor heat exchanger to receive makeup air therefrom.

12. The packaged terminal air condition unit of claim 10, wherein the support bracket defines a plurality of parallel air channels upstream from the exhaust air filter.

13. The packaged terminal air condition unit of claim 10, wherein the exhaust air filter is vertically-sandwiched between the louver cap and the support bracket.

14. The packaged terminal air condition unit of claim 10, wherein the louver cap comprises a plurality of louvers extending across a top surface of the exhaust air filter and plurality of interior tabs extending beneath a bottom surface of the exhaust air filter, the plurality of interior tabs holding the exhaust air filter against the plurality of louvers.

15. The packaged terminal air condition unit of claim 10, wherein the louver cap comprises a plurality of attachment tabs extending outward from the louver cap in selective engagement with the support bracket.

16. The packaged terminal air condition unit of claim 10, wherein the louver cap comprises a sidewall disposed about the exhaust air filter.

17. A packaged terminal air conditioner unit for conditioning an indoor space, the packaged terminal air conditioner unit comprising:

a housing defining an indoor portion and an outdoor portion, the housing comprising a cabinet enclosing at least a portion of the indoor portion and a head unit attached to the cabinet above the indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor to circulate a refrigerant between the outdoor heat exchanger and the indoor heat exchanger;

a bulkhead disposed within the housing between the outdoor heat exchanger and the indoor heat exchanger along a transverse direction, the bulkhead defining a vent aperture therethrough; and a filter assembly supported on the head unit, the filter assembly comprising a support bracket attached to the head unit above the indoor heat exchanger, an exhaust air filter disposed on the support bracket in fluid communication with the indoor portion to receive air therefrom, and a louver cap disposed over the exhaust air filter and downstream therefrom, the louver cap being selectively attached to the support bracket, wherein the exhaust air filter is selectively fixed to the louver cap to move therewith relative to the housing, wherein the louver cap comprises a plurality of louvers extending across a top surface of the exhaust air filter and plurality of interior tabs extending beneath a bottom surface of the exhaust air filter, the plurality of interior tabs holding the exhaust air filter against the plurality of louvers, wherein the louver cap comprises a sidewall disposed about the exhaust air filter, and wherein the exhaust air filter is vertically-sandwiched between the louver cap and the support bracket.

18. The packaged terminal air condition unit of claim 17, wherein the filter assembly is in selective downstream fluid communication with the outdoor heat exchanger to receive makeup air therefrom.

19. The packaged terminal air condition unit of claim 17, wherein the support bracket defines a plurality of parallel air channels upstream from the exhaust air filter.

20. The packaged terminal air condition unit of claim 17, wherein the louver cap comprises a plurality of attachment tabs extending outward from the louver cap in selective engagement with the support bracket.

* * * * *